US007654910B2

(12) United States Patent
Chen

(10) Patent No.: US 7,654,910 B2
(45) Date of Patent: Feb. 2, 2010

(54) MAZE DEVICE

(76) Inventor: Xing Chen, 16323 Sturkie Ct., Charlotte, NC (US) 28277

( * ) Notice: Subject to any disclaimer, the term of this patent is extended or adjusted under 35 U.S.C. 154(b) by 348 days.

(21) Appl. No.: 11/749,794

(22) Filed: May 17, 2007

(65) Prior Publication Data

US 2008/0282621 A1 Nov. 20, 2008

(51) Int. Cl.
*A63J 11/00* (2006.01)
*A63H 33/30* (2006.01)

(52) U.S. Cl. ..... 472/62; 446/476; 446/478

(58) Field of Classification Search ..... 472/62, 472/136; 446/476, 478; 273/153 R, 118 R, 273/113, 109; 52/60, 64, 36.1, 239; 135/125, 135/126, 128, 144, 106
See application file for complete search history.

(56) References Cited

U.S. PATENT DOCUMENTS 3,485,494 A 12/1969 Lieberman
3,921,348 A 11/1975 Kurzen
4,154,439 A 5/1979 Landsborough
4,154,440 A 5/1979 Rusk
4,811,751 A * 3/1989 Maloney, II ..... 135/125
4,819,389 A 4/1989 Kihn
5,046,720 A 9/1991 Bolly
5,219,316 A * 6/1993 Huffman ..... 472/62
5,474,501 A 12/1995 Teng
5,975,101 A * 11/1999 Zheng ..... 135/125
6,398,659 B1 6/2002 Karg
6,474,025 B1 * 11/2002 Faiks et al. ..... 52/36.1
6,575,462 B2 * 6/2003 Roy ..... 273/153 R
6,675,538 B2 1/2004 Candio
6,851,439 B2 * 2/2005 Zheng ..... 135/126
7,137,898 B2 * 11/2006 Savage ..... 472/62
7,364,487 B2 * 4/2008 Evans et al. ..... 446/108

* cited by examiner

*Primary Examiner*—Kien T Nguyen
(74) *Attorney, Agent, or Firm*—Jay Schloff

(57) ABSTRACT

Disclosed is a multi-modular maze device comprising a plurality of maze modules interconnected using a plurality of adaptors to configure a plurality of interconnected pathways. The maze modules and the adaptors are removably engaged to each other using hook and loop fastening arrangements. The maze device is capable of being removably installed on a supporting surface (for example, floor), either outdoor or indoor.

19 Claims, 5 Drawing Sheets

MAZE DEVICE

FIELD OF THE INVENTION

The present invention relates generally to maze devices, and, more particularly, to restructurable maze devices providing a plurality of interconnected pathways.

BACKGROUND OF THE INVENTION

Maze devices or labyrinths having a plurality of interconnected pathways have been in existence for a long time. The conventional maze devices have been built with walls and rooms, with hedges, turfs or with paving stones of contrasting colors or designs, or in fields of crops. However, the conventional maze devices are usually permanent structures, thereby not capable of being removably installed on a supporting surface. Such maze devices are not adapted to be installed indoor and/or outdoor at the convenience of the user. Another problem is storage and transportation of the maze devices, since the mazes are not made from light-weight structural units.

Accordingly, what is needed is a maze device that has the advantage of being removably mounted on a supporting surface, is easily transportable, configured from light structural units for providing a plurality of interconnected pathways in a fast, easy, and cost-efficient manner.

SUMMARY OF THE INVENTION

In view of the foregoing disadvantages inherent in the prior art, the general purpose of the present invention is to provide a maze device configured to include all the advantages of the prior art, and to overcome the drawbacks of the prior art.

In a first aspect, the present invention provides a maze device, comprising a plurality of maze modules and a plurality of adaptors capable of being installed on a supporting surface.

Each maze module configures a module base section on the supporting surface. Each maze module comprises: a plurality of first arched frames configured longitudinally along a first side of the module base section such that a top portion of each first arched frame is positioned above the module base section, and side end portions of first arched frames rest on the module base section, with the side end portions of consecutive first arched frames resting on the module base section in proximity with each other, thereby defining a first side of each maze module; a plurality of second arched frames configured longitudinally along a second side of the module base section lying opposite and in parallel to the first side of the module base section, such that a top portion of each second arched frame is positioned above the module base section, and side end portions of second arched frames rest on the module base section, with the side end portions of consecutive second arched frames resting on the module base section in proximity with each other, thereby defining a second side of each maze module; and a plurality of third arched frames extending between the first and second sides of each maze module such that a top portion of each third arched frame is positioned above the module base section, a first side end portion of each third arched frame rests on the module base section in proximity to the side end portions of the first arched frames, and a second side end portion of each third arched frame rests on the module base section in proximity to the side end portions of the second arched frames. The third arched frames comprise a front arched frame at a front of each maze module, and a back arched frame at a back of each maze module.

Each maze module further comprises: a plurality of top covers configured to cover a top of the maze module, wherein each top cover is disposed between a first arched frame, a second arched frame, and two third arched frames, and engaged to the top portions of the first arched frame, the second arched frame and the two third arched frames; and a plurality of side covers configured to cover the first and second sides of the maze module, wherein each first arched frame and each second arched frame has a side cover extending along a complete length of first arched frame and the second arched frame.

Each adaptor configures an adaptor base section on the supporting surface. Each adaptor comprises: four adaptor arched frames along four sides of the adaptor base section such that a top portion of each adaptor arched frame is positioned above the adaptor base section, and side end portions of consecutive adaptor arched frames rest on the adaptor base section in proximity with each other; and an adaptor cover engaged to the top portions of the adaptor arched frames and configured to cover a top of the adaptor.

The maze modules engage with the adaptors such that at least one of the front and back arched frames of the maze modules removably engage with the adaptor arched frames to configure a plurality of interconnected pathways on the supporting surface. The front and back arched frames of the maze modules are removably engaged with the adaptor arched frames using at least one of hook and loop fastening arrangements and zipper chain fastening arrangements. Also, an adaptor arched frame of at least one adaptor serves as a door for ingress and egress from the maze device In another aspect, the present invention provides a method of configuring a restructurable maze device having a plurality of interconnected pathways using the maze modules and the adaptors as described in the first aspect of the present invention.

In another aspect, the present invention provides a maze device, comprising a plurality of maze modules capable of being installed on a supporting surface. Each maze module configures a module base section on the supporting surface.

Each maze module comprises: at least one first arched frame configured longitudinally along a first side of the module base section such that a top portion of the first arched frame is positioned above the module base section, and side end portions of the first arched frames rest on the module base section, with the side end portions of consecutive first arched frames resting on the module base section in proximity with each other, the first arched frames thereby defining a first side of each maze module; at least one second arched frame configured longitudinally along a second side of the module base section lying opposite and in parallel to the first side of the module base section such that a top portion of the second arched frame is positioned above the module base section, and side end portions of the second arched frames rest on the module base section, with the side end portions of consecutive second arched frames resting on the module base section in proximity with each other, the second arched frames thereby configuring a second side of each maze module; and a plurality of third arched frames extending between the first and second sides of each maze module such that a top portion of each third arched frame is positioned above the module base section, a first side end portion of each third arched frame rests on the module base section in proximity to the side end portions of the first arched frames, and second side end portion of each third arched frame is rests on the module base section in proximity to the side end portions of the second arched frames. The third arched frames comprise a front arched frame at a front of each maze module and a back arched frame at a back of each maze module.

Each maze module further comprises at least one top cover configured to cover a top of the maze module, wherein each top cover is disposed between a first arched frame, a second arched frame, and two third arched frames, and engaged to the top portions of the first arched frame, the second arched frame and the two third arched frames.

Further, at least some of the maze modules have a plurality of side covers configured to cover the first and second sides of the maze module, wherein each first arched frame and each second arched frame has a side cover extending along a complete length of first arched frame and the second arched frame.

The maze modules are engaged to each other such that at least one of the front and back arched frames of the maze modules having the side covers removably engage with at least one of the first arched frames, the second arched frames and the third arched frames of remaining maze modules to configure a plurality of interconnected pathways on the supporting surface. Furthermore, at least one of first arched frames, the second arched frames and the third arched frames of at least one the remaining maze modules serves as a door for ingress and egress from the maze device.

These together with other aspects of the present invention, along with the various features of novelty that characterize the invention, are pointed out with particularity in the claims annexed hereto and form a part of this disclosure. For a better understanding of the invention, its operating advantages, and the specific objects attained by its uses, reference should be made to the accompanying drawings and descriptive matter in which there are illustrated exemplary embodiments of the present invention.

BRIEF DESCRIPTION OF THE DRAWINGS

The advantages and features of the present invention will become better understood with reference to the following detailed description and claims taken in conjunction with the accompanying drawings, wherein like elements are identified with like symbols, and in which:

Figure 2:
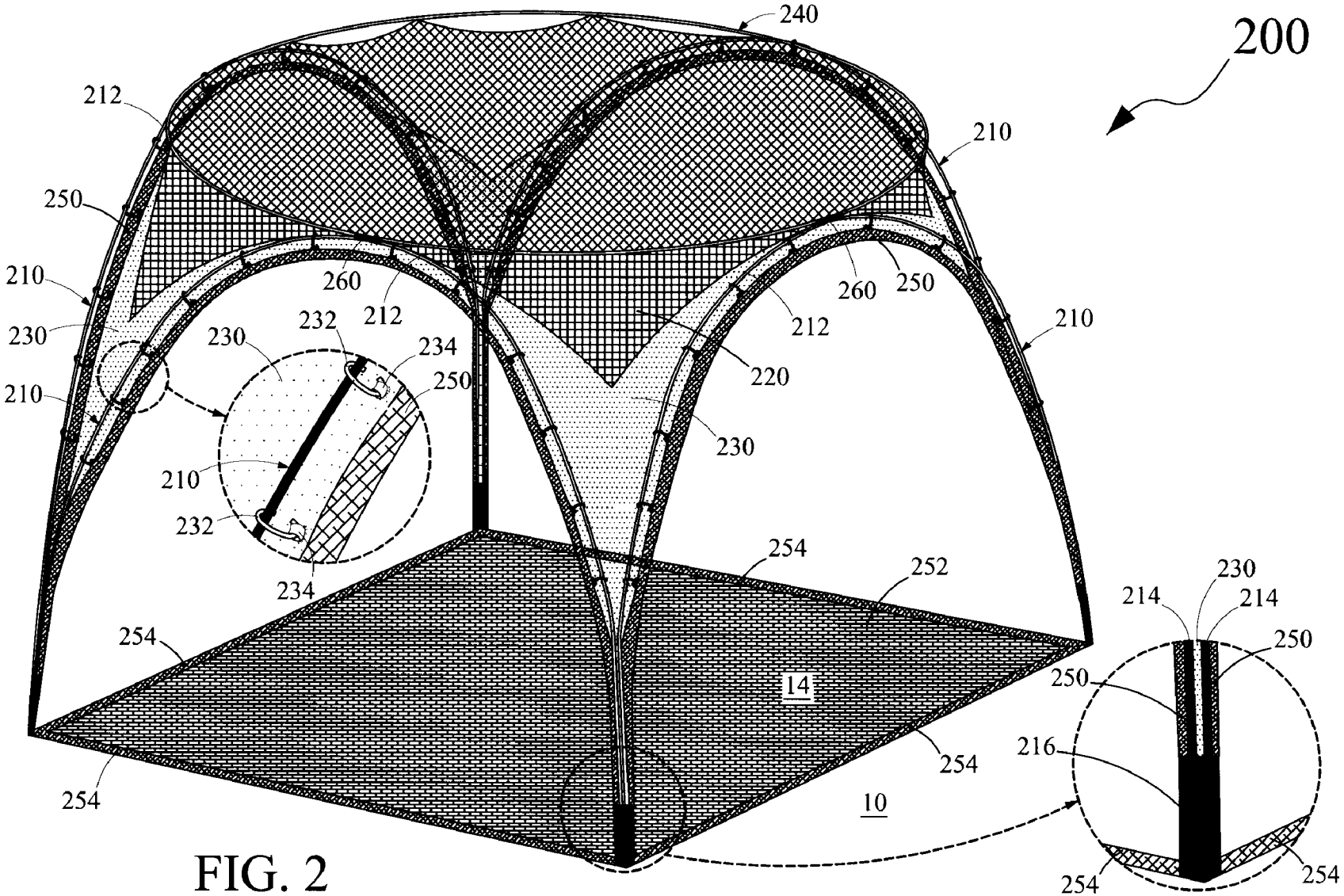
Figure 3:
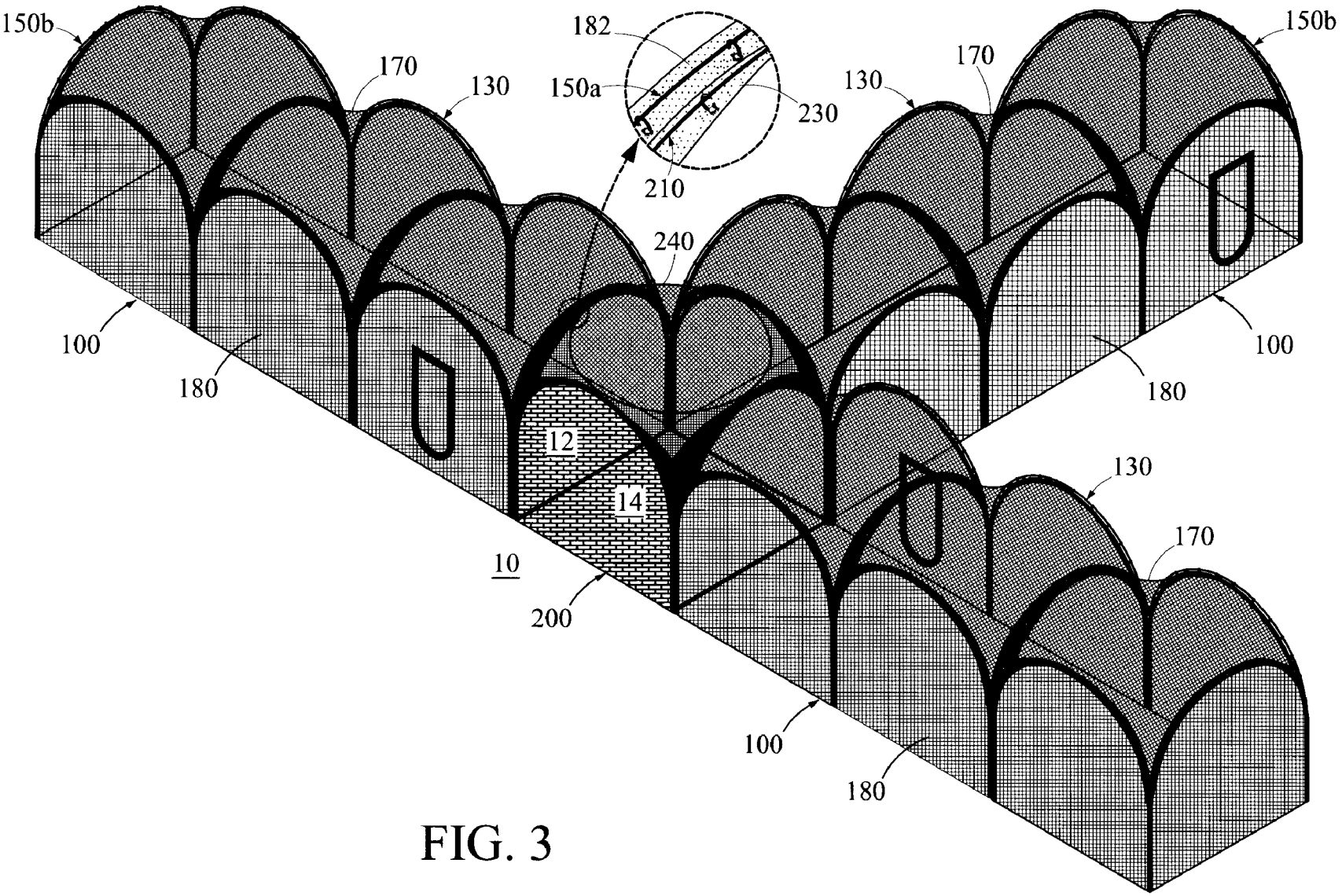
Figure 4:
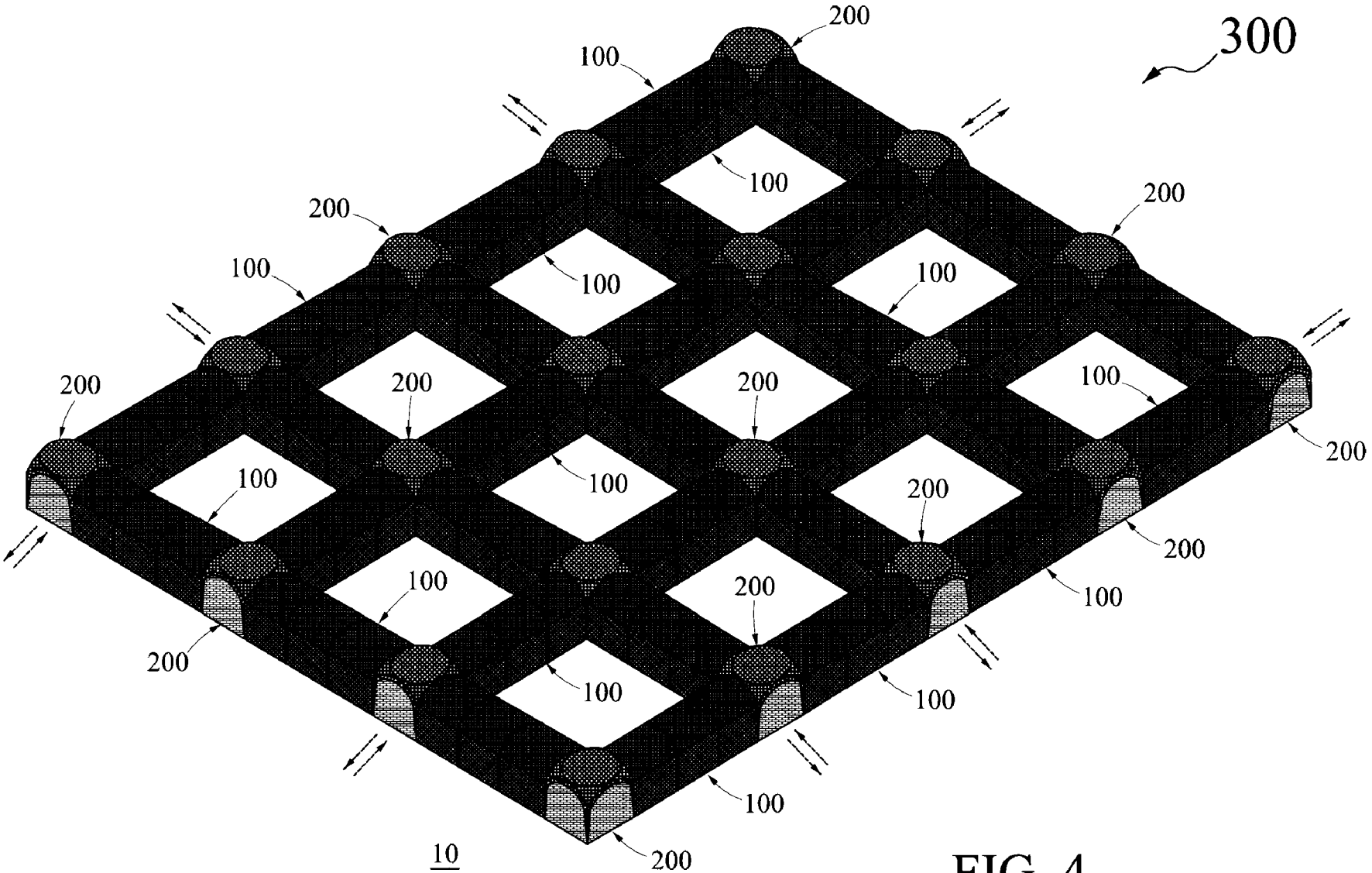

FIG. IA is a perspective view with magnified sub-views of a basic framework of the maze module 100 showing a plurality of first arched frames 110, a plurality of second arched frames 130, and a plurality of third arched frames, according to an embodiment of the present invention;

FIG. 2 is a perspective view with magnified sub-views of an adaptor 200 of the maze device, according to an embodiment of the invention;

FIG. 3 is a perspective view of the adaptor 200 engaging three maze modules 100, according to an embodiment of the present invention; and FIG. 4 is a top perspective view of a maze device 300, according to an embodiment of the present invention.

Like reference numerals refer to like parts throughout the description of several views of the drawings.

DETAILED DESCRIPTION OF THE INVENTION

The exemplary embodiments described herein detail for illustrative purposes are subject to many variations in structure and design. It should be emphasized, however, that the present invention is not limited to a particular maze device, as shown and described. It is understood that various omissions, substitutions, and equivalents are contemplated as circumstances may suggest or render expedient, but it is intended to cover the application or implementation without departing from the spirit or scope of the claims of the present invention. The terms "a" and "an" herein do not denote a limitation of quantity, but rather denote the presence of at least one of the referenced item.

The present invention provides a multi-modular maze device for commercial amusement or recreational activity. The maze device is in the form of a 'maze style play cage' having a plurality of interconnected pathways and door(s) for ingress and egress of users from the maze device. The multi-modular maze device may be used to test the skills of a person on basis of his/her ability to find the correct path through the maze. Additionally, group games, such as, paintball, air soft shooting, and the like, may be played inside the maze device.

The maze device comprises a plurality of maze modules interconnected using a plurality of adaptors to configure the interconnected pathways. The maze device is capable of being removably installed on a supporting surface (for example, a floor), either outdoors or indoors. The maze modules and the adaptors are detachable from each other and the maze device may be restructured to form a different pattern of interconnected pathways in a fast, easy and reliable manner. Additionally, the maze device of the present invention is inexpensive when compared to maze devices having rigid structural configuration.

Figure 1:
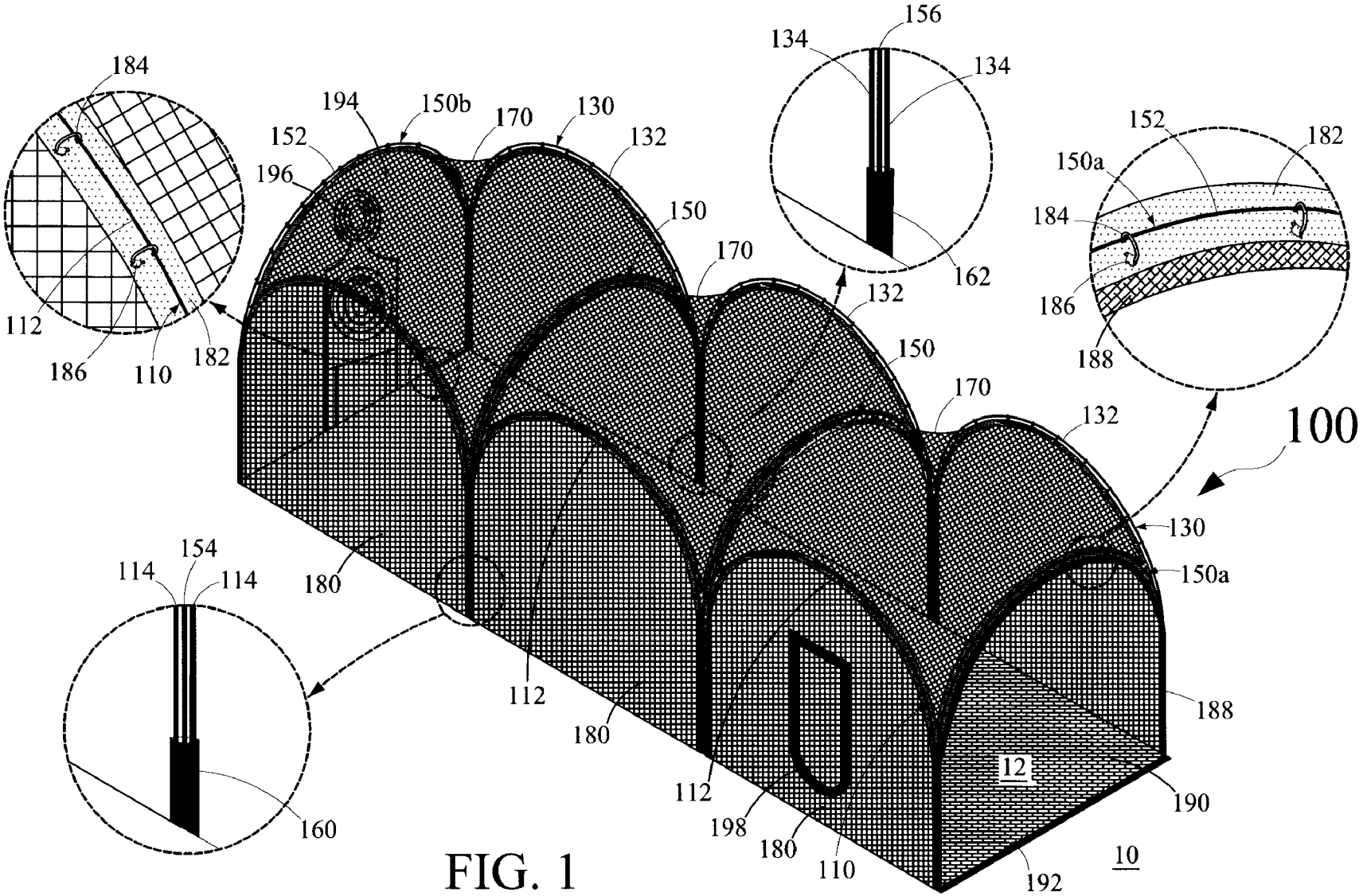
FIG. 1 is a perspective view with magnified sub-views of a maze module 100 of a maze device, according to an embodiment of the present invention.
Figure 1A:
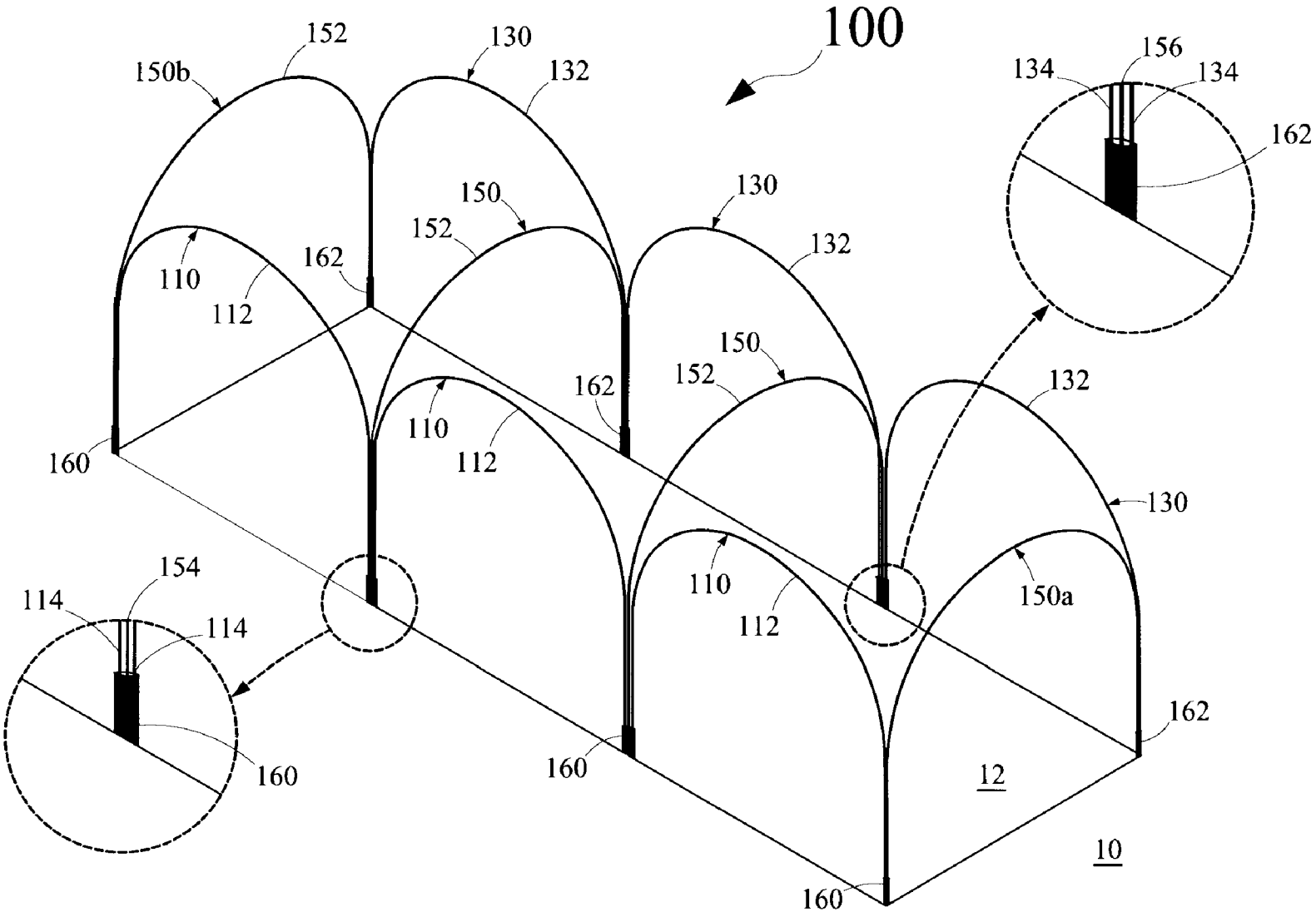

Referring to FIGS. 1 and 1A, a maze module 100, is shown, configuring a module base section 12 on a supporting surface 10. The maze module 100 comprises a plurality of arched frames configuring the basic framework structure of the maze module 100. As used herein, an 'arched frame' generally refers to a semi-circular frame-structure shaped like an inverted 'U' comprising a top portion and two side end portions. The arched frames may have foldable structural features for folding the arched frames, when not in use. Such foldable structural features may be advantageously used for saving space during storage and transportation of the arched frames. For example, when folded, the arched frames may be stored and transported in a pole storage bag.

The maze module 100 comprises a plurality of first arched frames 110, a plurality of second arched frames 130, and a plurality of third arched frames 150. The first arched frames 110, the second arched frames 130, and the third arched frames 150 may be made of any material providing sufficient structural integrity to the basic framework of the maze module 100, while also being flexible enough to be suitably installed on the supporting surface 10. Suitable materials include, but are not limited to, fiberglass and aluminum.

The first arched frames 110 are configured longitudinally along a first side of the module base section 12, such that, a top portion 112 of each first arched frame 110 is positioned above the module base section 12 and side end portions 114 of the first arched frames 110 rest on the module base section 12. The side end portions 114 of consecutive first arched frames 110 rest on the module base section 12 in proximity with each other, with or without contacting each other. The first arched frames 110 together define a first side of the maze module 100.

The second arched frames 130 are configured longitudinally along a second side of the module base section 12, such that, a top portion 132 of each second arched frame 130 is positioned above the module base section 12 and side end portions 134 of the second arched frames 130 rest on the module base section 12. The side end portions 134 of consecutive second arched frames 130 rest on the module base section 12 in proximity with each other, with or without contacting each other. The second arched frames 130 together define a second side of the maze module 100.

The third arched frames 150 extend between the first and the second sides of the maze module 100. A top portion 152 of each third arched frame 150 is positioned above the module base section 12. Also, a first side end portion 154 of each third arched frame 150 rest on the module base section 12 in proximity to side end portions 114 of the first arched frames 110, and a second side end portion 156 of each third arched frame 150 is resting on the module base section 12 in proximity to side end portions 134 of the second arched frames 130.

Each set of either one or two first arched frames 110 and one third arched frame 150 have their side end portions 114, 154 resting on the module base section 12 in proximity with each other, with or without contacting each other. The first arched frames and the third arched frame 150 may be connected together at their side end portions 114, 154 using loops, snaps, clips, and the like. Such a connection restricts any unwanted movement of side end portions 114, 154 that may result in deforming the basic framework structure of the maze module 100. Alternatively, the side end portions 114, 154 may be received into a first side pocket 160 (See FIG. 1) disposed on the supporting surface 10. The first side pocket 160 is capable of effectively housing the side end portions 114, 154 for restricting any unwanted movement of the side end portions 114, 154.

Similarly, the side end portions 134, 156 of the second arched frames and the third arched frame 150 may be received into a second side pocket 162 (See FIG. 1) disposed on the supporting surface 10. The second side pocket 162 is capable of effectively housing the side end portions 114, 154 for restricting any unwanted movement of the side end portions 134, 154.

The third arched frames 150 comprise a front arched frame 150*a* at a front of each maze module, and a back arched frame 150*b* at a back of each maze module 100.

The maze module 100 further comprises a plurality of top covers 170 configured to cover a top of the maze module 100. Each top cover is disposed between a first arched frame 110, a second arched frame 130, and two third arched frames 150. The top cover 170 is engaged to the top portion 112 of the first arched frame 110, the top portion 132 of the second arched frame 130 and the top portions 152 of the two third arched frames 150.

The maze module 100 further comprises a plurality of side covers 180 configured to cover the first and second side of the maze module 100. Each first arched frame 110 and each second arched frame 130 has a side cover 180 extending along a complete length of first arched frame 110 and the second arched frame 130.

The top covers 170 and the side covers 180 may be made of any material providing sufficient support to the basic framework of the maze module 100, while also desirably covering a top and sides of the maze module 100. Preferably, the top covers 170 and the side covers 180 may be made of a fabric material ranging from tightly woven translucent or nearly opaque material to loosely woven open mesh material (i.e., a netting material). Such fabric materials may be similar to the materials used as covering for conventional tents. The material may possess least one of waterproof features, fire retardant features, mosquito netting features, and other features desirable to the users.

The top covers 170 may be removably engaged to the first arched frames 110, the second arched frames 130, and the third arched frames 150 using suitable engagement features, for example, hooks and loops. One end of a hook may engage with the arched frames 110, 130, 150, while the other end may removably engage with web loops disposed on the top covers 170. As described for top covers 170, similar engagement features, may be used to engage the side covers 180 to the first arched frames 110 and the second arched frames 130.

Alternatively, the top covers 170 and the side covers 180 may be engaged to the arched frames using intermediate members. As shown in FIG. 1, the intermediate members are in the form of edge members 182 disposed between the top covers 170 and the side covers 180 and extending along a complete circumference of the top covers 170 and the side covers 180. The edge members 182 may be made of a tightly woven nearly opaque material for providing strength and additional support to the basic framework of the maze module 100.

The edge members 182 engage to the arched frames 110, 130, 150 using suitable engagement features, for example hooks and web loops. As shown in FIG. 1, the maze module 100 comprises a plurality of hooks 184 fixedly or removably engaged at one end to a plurality of loops 186 disposed on the edge member 182. The hooks 184 may hook onto the arched frames 110, 130, 150, thereby engaging the edge members 182 to the arched frames 110, 130, 150.

Referring to FIG. 2, an adaptor 200, is shown, configuring an adaptor base section 14 on the supporting surface 10. The adaptor 200 comprises four adaptor arched frames 210 along four sides of the adaptor base section, configuring a basic framework of the adaptor 200. A top portion 212 of each adaptor arched frame 210 is positioned above the adaptor base section. The side end portions 214 of consecutive adaptor arched frames 210 are resting on the adaptor base section 14 in proximity with each other, with or without contacting each other.

The consecutive adaptor arched frames 210 may be connected together at their side end portions 214 using loops, snaps, clips, and the like. Such a connection restricts any unwanted movement of side end portions 214 that may otherwise result in deforming the basic framework of the adaptor 200. Alternatively, the side end portions 214 of consecutive adaptor arched frames 210 may be received into an adaptor pocket 216 (See FIG. 2). The adaptor pocket 216 is capable of effectively housing the side end portions 214 for restricting any unwanted movement of the side end portions 214.

The adaptor arched frames 210 may be made of fiberglass or aluminum or any other material providing sufficient structural integrity to the basic framework of the adaptor 200, while also being flexible enough to be suitably installed on the supporting surface 10.

The adaptor 200 further comprises an adaptor cover 220 configured to cover a top of the adaptor. The adaptor cover 220 is disposed between the adaptor arched frames 210 and engaged to the top portions 212 of the adaptor arched frames 210. The adaptor cover 220 may be made of any material providing sufficient support to the basic framework of the adaptor 200. Preferably, the adaptor cover 220 may be made of a fabric material ranging from tightly woven translucent or nearly opaque material to loosely woven open mesh material (i.e., a netting material). Such fabric materials may be similar to the materials used as covering for conventional tents. The material may possess least one of waterproof features, fire retardant features, mosquito netting features, and other features desirable to the users.

Suitable engagement features, for example, hooks and loops, may be used for removably engaging the adaptor cover 220 to the adaptor arched frames 210. Alternatively, as described for the top covers 170 and the side covers 180, the adaptor 200 has an adaptor edge member 230 (See FIG. 2)

extending along a complete circumference of the adaptor cover 220. The adaptor edge member 230 may be made of a tightly woven nearly opaque material for providing structural strength and additional support to the basic framework structure of the maze module 100.

The adaptor edge member 230 engages to the adaptor arched frames 210 using similar engagement features, as described for the edge members 182 of the maze module 100. As shown in FIG. 2, the adaptor 200 comprises a plurality of hooks 232 fixedly or removably engaged at one end to a plurality of loops 234 disposed on the adaptor edge member 230. The hooks 232 may hook onto the adaptor arched frames 210, thereby engaging the adaptor edge member 230 to the adaptor arched frames 210.

Additionally, the adaptor 200 comprises a top circular frame 240 disposed on top of the adaptor 200, and more specifically, on top of the adaptor cover 220. The top circular frame 240 engages to the top portions 212 of the adaptor cover 220 using loops 260, snaps, clips, and the like. The top circular frame is made of material flexible enough to aid the adaptor 200 to expand on the supporting surface 10, while also strengthening the basic framework of the adaptor 200. Suitable materials include, but are not limited to, fiberglass and aluminum.

Optionally, the maze module 100 comprises a module floor section 190 covering the module base section 12. Similarly, the adaptor 200 comprises an adaptor floor section 252 covering the adaptor base section 14. The module floor section 190 and the adaptor floor section 252 may be made of any material providing sufficient cushioning to the users walking through the maze module 100 and the adaptor 200, while also preventing the supporting surface 10 from getting damaged due to frequent usage. In one embodiment, the module floor section 190 and the adaptor floor section are made of at least one of nylon and ethylene-vinyl acetate foam.

The maze module 100 and the adaptor 200 can be removably engaged to each other. More specifically, at least one of the front arched frame 150*a* and the back arched frame 150*b* of the maze module 100 is capable of removably engaging with the adaptor arched frames 210. For such an engagement, engagement features (e.g., hooks, ribs, threaded bolts, screws, insert posts, hinges, buttons, and/or the like) are disposed along at least a portion of the front arched frame 150*a* and the back arched frame 150*b* that removably engage with complementary engagement features (e.g., loops, slots, threaded sleeves, grooves, insert holes, button receiving slots and/or the like) disposed along at least a portion of the adaptor arched frames 210.

In one embodiment, at least one of the front arched frame 150*a* and the back arched frame 150*b* are removably engaged to the adaptor arched frames 210 using hook and loop fastening arrangements (also referred to as Velcro® fasteners) or zipper chain fastening arrangements. The maze module 100 comprises an engagement edge 188 (e.g., a hook strip) extending downwardly from the edge member 182 along the complete length of the front arched frame 150*a* that removably engages with one of the complementary engagement edges 250 (e.g., a loop strip) extending downwardly from the adaptor edge member 230 along the complete length of the adaptor arched frames 210.

Additionally, the module floor section 190 and the adaptor floor section 252 may removably engage with each other for further strengthening the engagement between the maze module 100 and the adaptor 200. More specifically, the module floor section 190 comprises a floor engagement edge 192 that removably engages with one of the complementary floor engagement edges 254 of the adaptor floor section 252. Such an engagement between the floor engagement edge 192 and the complementary floor engagement edge 254 in combination with the engagement between the engagement edge 188 and complementary engagement edges 250 result in an engagement where all edges of the maze module 100 and the adaptor 200, from the arched frames to the floors are engaged. Also, such an engagement provides a smooth pathway for moving between the maze module 100 and the adaptor 200.

Optionally, the maze modules 100 may be interconnected with each other. For this, at least one of the front and back arched frames 150*a*, 150*b* of at least some of the maze modules 100 have an engagement edge that removably engage with complementary engagement edge of the front and back arched frames 150*a*, 150*b* of the remaining maze modules 100. Alternatively, a front arched frame 150 of a maze module 100 has an engagement edge that removably engages with a complementary engagement edge of a back arched frame 150*b* another maze module 100.

The present invention provides a method for constructing a multi-modular maze device using multiple maze modules 100 and the adaptors 200. The maze modules 100 may be available as complete units. Alternatively the first arched frames 110, the second arched frames 130, the third arched frames 150, the top covers 170, the side covers 180, and other essential components may be assembled to form the maze module 100, at a desired site. Similarly, for the adaptors, the adaptor arched frames 210, the adaptor cover 220, the top circular frame 240, and other essential components may be assembled to form the adaptor 200, at the desired site.

Next, the maze modules 100 and the adaptors 200 are removably engaged with each other to configure the interconnected pathways. As shown in FIG. 3, the front arched frames 150*a* of three maze modules 100 are removably engaged with three adaptor arched frames 210. Thereafter, the back arched frames 150*b* may be removably engaged with adaptor arched frames 210 of other adaptors 200.

Such a method of removably engaging the maze modules 100 and the adaptors 200 may be continued to result in any desired maze of interconnected pathways. For example, referring to FIG. 4, a maze device 300 comprising a plurality of maze modules 100 interconnected using a plurality of adaptors 200 to configure the interconnected pathways. Such a maze device 300 has an adaptor arched frame 210 of at least one adaptor 200 serving as a door for ingress and egress from the maze device 300.

The maze module 100 may comprise additional components for providing additional functionality to the maze module 100. For example, the maze module 100 comprises a back cover 194 (See FIG. 1) configured to cover a back of the maze module 100. The back cover 194 extends along a complete length of the back arched frame 150*b*. The back cover may be made of a fabric material ranging from tightly woven translucent or nearly opaque material to loosely woven open mesh material (i.e., a netting material). In one embodiment, the back cover 194 is made of nylon.

The back cover 194 may be removably engaged to the back arched frame 150*b* using zipper chain fastening arrangements or hook and loop fastening arrangements. Similarly, the maze module may comprise a front cover (not shown) removably engaged to the front arched frame 150*a* and configure to cover a front of the maze module 100. Either of the back cover 194 or the front cover may be detached from the maze module 100 to attach the adaptors 200 to the front arched frame 150*a* and/or the back arched frame 150*b*.

As shown in FIG. 1, a backdrop target 196 may be disposed on the back cover 194. Alternatively, or in addition, aesthetic decorations and/or designs, product, manufacturer information, and/or source identifiers, logos, message providing game instructions or hints, and the like may be disposed on one or more surfaces of the maze module 100.

Optionally, a portion of at least one side cover 180 is configured as a side door panel 198 using zipper chain fastening arrangements. The side door panel 198 is capable of being unzipped to form a side door for ingress and egress from the maze device 300.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, and to thereby enable others skilled in the art to best utilize the invention and various embodiments with various modifications as are suited to the particular use contemplated. It is understood that various omissions, substitutions, and equivalents are contemplated as circumstances may suggest or render expedient, but it is intended to cover the application or implementation without departing from the spirit or scope of the claims of the present invention.

CALL OUT LIST

Maze Device

10 supporting surface
12 module base section
14 adaptor base section
100 maze module
110 first arched frames
112 top portion of the first arched frames 110
114 side end portions of the first arched frames 110
130 second arched frames
132 top portion of the second arched frames 130
134 side end portions of the second arched frames 130
150 third arched frames
150*a* front arched frame
150*b* back arched frame
152 top portion of third arched frames 150
154 first side end portion of the third arched frames 150
156 second side end portion of the third arched frames 150
160 first side pocket
162 second side pocket
170 top covers
180 side covers
182 edge member
184 hooks
186 loops
188 enagagment edge
190 module floor section
192 floor engagement edge
194 back cover
196 backdrop target
198 side door panel
200 adaptor
210 adaptor arched frames
212 top portions of the adaptor side arched frames 210
214 side end portions of the adaptor side arched frames
216 adaptor pocket
220 adaptor cover
230 adaptor edge member
232 hooks
234 loops
240 top circular frame
250 complementary engagement edges
252 adaptor floor section
254 complementary floor engagement edge
260 loops

What is claimed is:

1. A maze device, comprising:

a plurality of maze modules capable of being installed on a supporting surface, each maze module configuring a module base section on the supporting surface, and each maze module comprising a plurality of first arched frames configured longitudinally along a first side of the module base section such that a top portion of each first arched frame is positioned above the module base section, and side end portions of the first arched frames rest on the module base section, with the side end portions of consecutive first arched frames resting on the module base section in proximity with each other, thereby defining a first side of each maze module, a plurality of second arched frames configured longitudinally along a second side of the module base section lying opposite and in parallel to the first side of the module base section such that a top portion of each second arched frame is positioned above the module base section, and side end portions of the second arched frames rest on the module base section, with the side end portions of consecutive second arched frames resting on the module base section in proximity with each other, thereby defining a second side of each maze module, a plurality of third arched frames extending between the first and second sides of each maze module such that a top portion of each third arched frame is positioned above the module base section, a first side end portion of each third arched frame rests on the module base section in proximity to the side end portions of the first arched frames, and a second side end portion of each third arched frame rests on the module base section in proximity to the side end portions of the second arched frames, the third arched frames comprising a front arched frame at a front of each maze module, and a back arched frame at a back of each maze module, a plurality of top covers configured to cover a top of the maze module, wherein each top cover is disposed between a first arched frame, a second arched frame, and two third arched frames, and engaged to the top portions of the first arched frame, the second arched frame and the two third arched frames, and a plurality of side covers configured to cover the first and second sides of the maze module, wherein each first arched frame and each second arched frame has a side cover extending along a complete length of the first arched frame and the second arched frame; and a plurality of adaptors capable of being installed on the supporting surface, each adaptor configuring an adaptor base section on the supporting surface, each adaptor comprising four adaptor arched frames along four sides of the adaptor base section such that a top portion of each adaptor arched frame is positioned above the adaptor base section, and side end portions of consecutive adaptor arched frames rest on the adaptor base section in proximity with each other, and an adaptor cover engaged to the top portions of the adaptor arched frames and configured to cover a top of the adaptor;

wherein at least one of the front and back arched frames of the maze modules removably engage with the adaptor arched frames to configure a plurality of interconnected pathways on the supporting surface; and wherein an adaptor arched frame of at least one adaptor serves as a door for ingress and egress from the maze device.

2. The maze device of claim 1, further comprising an engagement edge extending along a complete length of at least one of the front and back arched frames, the engagement edge capable of removably engaging with complementary engagement edges extending along a complete length of the adaptor arched frames.

3. The maze device of claim 2, wherein the engagement edge and the complementary engagement edges comprise one of complementary features of a hook and loop fastening arrangement and complementary mating halves of a zipper chain fastening arrangement.

4. The maze device of claim 1, further comprising a module floor section covering the module base section, and an adaptor floor section covering the adaptor base section.

5. The maze device of claim 4, wherein the module floor section has a floor engagement edge that is capable of removably engaging with complementary floor engagement edges on the adaptor floor section.

6. The maze device of claim 5, wherein the floor engagement edge and the complementary floor engagement edges comprise one of complementary features of a hook and loop fastening arrangement and complementary mating halves of a zipper chain fastening arrangement.

7. The maze device of claim 4, wherein the module floor section and the adaptor floor section are made of at least one of nylon and ethylene-vinyl acetate foam.

8. The maze device of claim 1, wherein the adaptor further comprises a top circular frame disposed on top of the adaptor, the top circular frame engaged to the adaptor cover.

9. The maze device of claim 1, wherein the first arched frames, the second arched frames, the third arched frames, and the adaptor arched frames are made from a material selected from the group consisting of fiberglass, aluminum, and combinations comprising at least one of the foregoing.

10. The maze device of claim 1, further comprising at least one of a front cover configured to cover a front of the maze module, the front cover extending across a complete length of the front arched frame, and a back cover configured to cover a back of the maze module, the back cover extending along a complete length of the back arched frame.

11. The maze device of claim 1, wherein a portion of at least one side cover is configured as a side door panel using zipper chain fastening arrangements, the side door panel capable of being unzipped to form a side door for ingress and egress from the maze device.

12. The maze device of claim 1, wherein at least one side end portion of a first arched frame and a first side end portion of a third arched frame are securely received within a first side pocket disposed on the supporting surface.

13. The maze device of claim 1, wherein at least one side end portion of a second arched frame and a second side end portion of a third arched frame are securely received within a second side pocket disposed on the supporting surface.

14. The maze device of claim 1, wherein side end portions of consecutive adaptor arched frames are securely received within an adaptor pocket disposed on the supporting surface.

15. The maze device of claim 1, further comprising an engagement edge extending along a complete length of at least one of the front and back arched frames of at least some of the maze modules, the engagement edge capable of removably engaging with a complementary engagement edge extending along a complete length of at least one of the front and back arched frames of remaining maze modules, for interconnecting maze modules together.

16. The maze device of claim 1, further comprising an engagement edge extending along a complete length of the front arched frame of the maze modules, the engagement edge capable of removably engaging with a complementary engagement edge extending along a complete length of the back arched frame of the maze modules, for interconnecting the maze modules together.

17. The maze device of claim 1, wherein the arched frames have foldable structural features for folding the arched frames.

18. A maze device, comprising:

a plurality of maze modules capable of being installed on a supporting surface, each maze module configuring a module base section on the supporting surface, and each maze module comprising at least one first arched frame configured longitudinally along a first side of the module base section such that a top portion of the first arched frame is positioned above the module base section, and side end portions of the first arched frames rest on the module base section, with the side end portions of consecutive first arched frames resting on the module base section in proximity with each other, the first arched frames thereby defining a first side of each maze module, at least one second arched frame configured longitudinally along a second side of the module base section parallely opposite to the first side of the module base section such that a top portion of the second arched frame is positioned above the module base section, and side end portions of the second arched frames rest on the module base section, with the side end portions of consecutive second arched frames resting on the module base section in proximity with each other, the second arched frames thereby configuring a second side of each maze module, a plurality of third arched frames extending between the first and second sides of each maze module such that a top portion of each third arched frame is positioned above the module base section, a first side end portion of each third arched frame rests on the module base section in proximity to the side end portions of the first arched frames, and a second side end portion of each third arched frame is rests on the module base section in proximity to the side end portions of the second arched frames, the third arched frames comprising a front arched frame at a front of each maze module, and a back arched frame at a back of each maze module, at least one top cover configured to cover a top of the maze module, wherein each top cover is disposed between a first arched frame, a second arched frame, and two third arched frames, and engaged to the top portions of the first arched frame, the second arched frame and the two third arched frames;

wherein at least some of the maze modules have a plurality of side covers configured to cover the first and second sides of the maze module, wherein each first arched frame and each second arched frame has a side cover extending along a complete length of first arched frame and the second arched frame;

wherein at least one of the front and back arched frames of the maze modules having the side covers removably engage with at least one of the first arched frame, the second arched frame and the third arched frames of remaining maze modules to configure a plurality of interconnected pathways on the supporting surface, the maze modules removably engaged to each other using at least one of hook and loop fastening arrangements, and zipper chain fastening arrangements; and wherein at least one of first arched frame, the second arched frame and the third arched frames of at least one the remaining maze modules serves as a door for ingress and egress from the maze device.

19. A module capable of being installed on a supporting surface, the module configuring a module base section on the supporting surface, the module comprising:

a plurality of first arched frames configured longitudinally along a first side of the module base section such that a top portion of each first arched frame is positioned above the module base section, and side end portions of the first arched frames rest on the module base section, with the side end portions of consecutive first arched frames resting on the module base section in proximity with each other, thereby defining a first side of the module, a plurality of second arched frames configured longitudinally along a second side of the module base section lying opposite and in parallel to the first side of the module base section such that a top portion of each second arched frame is positioned above the module base section, and side end portions of the second arched frames rest on the module base section, with the side end portions of consecutive second arched frames resting on the module base section in proximity with each other, thereby defining a second side of the module, a plurality of third arched frames extending between the first and second sides of each maze module such that a top portion of each third arched frame is positioned above the module base section, a first side end portion of each third arched frame rests on the module base section in proximity to the side end portions of the first arched frames, and a second side end portion of each third arched frame rests on the module base section in proximity to the side end portions of the second arched frames, the third arched frames comprising a front arched frame at a front of the module, and a back arched frame at a back of the module, a plurality of top covers configured to cover a top of the module, wherein each top cover is disposed between a first arched frame, a second arched frame, and two third arched frames, and engaged to the top portions of the first arched frame, the second arched frame and the two third arched frames, and a plurality of side covers configured to cover the first and second sides of the module, wherein each first arched frame and each second arched frame have a side cover extending along a complete length of the first arched frame and the second arched frame.

* * * * *